US010016790B1

(12) United States Patent
Travis et al.

(10) Patent No.: US 10,016,790 B1
(45) Date of Patent: Jul. 10, 2018

(54) DUAL ROBOTIC SORTING SYSTEM AND METHOD

(71) Applicant: K. B. C. Group, Inc., Urbandale, IA (US)

(72) Inventors: Stephen J. Travis, Johnston, IA (US); Thomas R. Johnston, Altoona, IA (US); Curt Matthew Davis, Ankeny, IA (US); Eric Andrew Pflueger, West Sacramento, CA (US)

(73) Assignee: K.B.C. Group, Inc., Urbandale, IA (US)

( * ) Notice: Subject to any disclaimer, the term of this patent is extended or adjusted under 35 U.S.C. 154(b) by 0 days.

(21) Appl. No.: 15/349,194

(22) Filed: Nov. 11, 2016

Related U.S. Application Data

(63) Continuation-in-part of application No. 14/675,913, filed on Apr. 1, 2015, now Pat. No. 9,492,848, which is a continuation of application No. 13/209,181, filed on Aug. 12, 2011, now Pat. No. 9,035,210, application No. 15/349,194, which is a continuation-in-part of application No. 14/512,864, filed on Oct. 13, 2014, now Pat. No. 9,656,301, which is a continuation of application No. 13/681,649, filed on Nov. 20, 2012, now Pat. No. 8,930,015.

(60) Provisional application No. 61/374,526, filed on Aug. 17, 2010.

(51) Int. Cl.

| | |
|---|---|
| ***B07C 5/00*** | (2006.01) |
| ***B07C 5/342*** | (2006.01) |
| ***B07C 5/36*** | (2006.01) |

(52) U.S. Cl.
CPC ..... *B07C 5/3422* (2013.01); *B07C 5/367* (2013.01); *Y10S 901/02* (2013.01); *Y10S 901/40* (2013.01); *Y10S 901/47* (2013.01)

(58) Field of Classification Search
CPC ..... B07C 5/3422; B07C 5/367; Y10S 901/02; Y10S 901/40; Y10S 901/47
USPC ..... 209/552, 577, 643
See application file for complete search history.

(56) References Cited

U.S. PATENT DOCUMENTS

| | | | | |
|---|---|---|---|---|
| 6,688,037 | B2 * | 2/2004 | Keller | A01C 7/042 414/737 |
| 7,600,642 | B2 * | 10/2009 | Deppermann | B07C 5/36 209/552 |
| 7,934,600 | B2 * | 5/2011 | Deppermann | A01C 1/00 209/512 |

(Continued)

*Primary Examiner* — Terrell H Matthews
(74) *Attorney, Agent, or Firm* — Brick Gentry PC; Brian J. Laurenzo; Jessica I. Susie

(57) ABSTRACT

A dual robotic sorting apparatus for identifying and sorting a product with at least two different sorting mechanisms is provided. In the preferred embodiment, the dual robotic sorting apparatus illuminates and images the product using at least one light source and imaging device, analyzes the image, and activates a specific sorting mechanism of a robotic arm to sort the product; wherein the dual sorting mechanism is a vacuum pickup tool, that picks up and places products in another location, and vacuum transport tool, that utilizes a suction tube to transport products to another location. Additionally, a plurality of robotic sorting apparatuses may be utilized. In the preferred embodiment of the dual robotic sorter, the CPU is capable of determining the most efficient method and type of pickup for each product identified for sorting.

28 Claims, 7 Drawing Sheets

(56) References Cited

U.S. PATENT DOCUMENTS

| | | | | |
|---|---|---|---|---|
| 7,967,149 | B2 * | 6/2011 | Helgi | B07C 5/16 209/552 |
| 8,030,588 | B2 * | 10/2011 | Culp | B07C 5/3412 209/552 |
| 8,189,901 | B2 * | 5/2012 | Modiano | B07C 5/34 250/339.07 |
| 9,035,210 | B1 * | 5/2015 | Davis | B07C 5/3422 209/539 |
| 9,650,215 | B2 * | 5/2017 | Girtman | B65G 59/02 |
| 2004/0267403 | A1 * | 12/2004 | Itoh | G01N 15/0205 700/214 |
| 2013/0127192 | A1 * | 5/2013 | Regan | B25J 15/0675 294/185 |
| 2014/0147239 | A1 * | 5/2014 | Miyoshi | B25J 15/0616 414/737 |
| 2016/0096643 | A1 * | 4/2016 | Baylor | B25J 15/0616 53/443 |
| 2016/0096694 | A1 * | 4/2016 | Baylor | B65B 5/06 414/774 |
| 2016/0199884 | A1 * | 7/2016 | Lykkegaard | B07C 5/02 700/223 |
| 2016/0332301 | A1 * | 11/2016 | Kesil | B25J 9/1682 |

* cited by examiner

DUAL ROBOTIC SORTING SYSTEM AND METHOD

CROSS-REFERENCE TO RELATED APPLICATIONS

This application is a Continuation-in-Part of U.S. Nonprovisional patent application Ser. No. 14/675,913 filed Apr. 1, 2015, titled "OPTICAL ROBOTIC SORTING APPARATUS" and U.S. Nonprovisional patent application Ser. No. 14/512,864 filed Oct. 13, 2014, titled "SORTING SYSTEM FOR DAMAGED PRODUCT", the entire disclosures of which are hereby incorporated by reference. U.S. patent application Ser. No. 14/675,913 is a continuation of U.S. Nonprovisional patent application Ser. No. 13/209,181 filed Aug. 12, 2011, titled "OPTICAL ROBOTIC SORTING METHOD AND APPARATUS", which issued as U.S. Pat. No. 9,035,210 on May 19, 2015, the entire disclosures of which are hereby incorporated by reference. U.S. Nonprovisional patent application Ser. No. 13/209,181, now U.S. Pat. No. 9,035,210, claims the benefit of U.S. Provisional Application No. 61/374,526, filed Aug. 17, 2010, the entire disclosure of which is hereby incorporated by reference. U.S. Nonprovisional patent application Ser. No. 14/512,864 is a continuation of U.S. Nonprovisional patent application Ser. No. 13/681,649 filed Nov. 20, 2012, titled "SORTING SYSTEM FOR DAMAGED PRODUCT", which issued as U.S. Pat. No. 8,930,015 on Jan. 6, 2015, the entire disclosures of which are hereby incorporated by reference.

FIELD OF THE INVENTION

The present invention relates to a robotic sorting apparatus. More specifically, the present invention relates to a robotic sorting method and apparatus for sorting products, specifically damaged products, on a conveyor, utilizing at least two available sorting mechanisms dynamically. The sorting system of the preferred embodiment of the present invention comprises a light source, an imaging device to identify damaged products from non-damaged products, and a sorting device wherein the sorting device comprises two or more tools for sorting damaged products from non-damaged products on a conveyor.

BACKGROUND

A little over fifty years ago picking, husking and sorting ears of corn would be done two or three rows at a time by a person in the field wearing a corn husking hook. Today ears of corn are usually mechanically harvested by a corn picker and maybe delivered to a corn husking unit to be husked. Corn husking units usually process a large number of ears of corn and often fail to completely remove the husk off of every ear of corn. After the ears of corn have been processed by the corn husking unit, the ears of corn must then be reviewed for flaws and sorted.

Ears of corn that still have a full husk, are partially husked, diseased, or rogue are considered defective and must be properly sorted and/or removed from the production stream. The sorting of the ears of corn has almost been exclusively done on a conveyor by human hands. Unfortunately, using human labor to sort the ears of corn has several drawbacks. Typically, the ears of corn are moving quickly along the conveyor so there is a need for multiple people sorting on each conveyor to accurately sort the ears of corn. In addition, people need to take breaks, occasionally get sick, and are unable to consistently repeat a process the same way every time. Furthermore, using human labor can have a high turnover rate and new employees must be trained. Therefore, the costs associated with sorting ears of corn may be reduced by automating the sorting process. There would be significant advantages of using an automated system instead of human labor.

There have been attempts to automate the process of sorting corn but none have been capable of effectively replacing a human. To effectively automate the corn sorting process, the automated corn sorter has to be able to identify the defective corn and be able to sort the defective corn into multiple sorting areas. The unhusked and partially husked corn must be returned to the husking unit, while the diseased and rogue corn must be removed from the process. Similarly, sorting other food products, such as walnuts, almonds, peaches, apricots, etc., using human labor have the same inherent deficiencies described above with human corn sorting.

Sorting systems are well known in the art. For some products, particularly those that require visual inspection, the systems require manual removal and are labor intensive. These systems also, in addition to being expensive to operate, are not as accurate as desired at an acceptable speed or require longer periods of sorting to increase accuracy. Accordingly, there is a need in the art for a system that addresses these needs.

Therefore an objective of the present invention is to provide a sorting system that is automated, with a high level of accuracy. Another objective of the present invention is to provide a sorting system that is less expensive and more efficient to operate. These and other objectives will be apparent to one skilled in the art based upon the following written description, drawings, and claims.

SUMMARY OF THE INVENTION

This Summary is provided to introduce a selection of concepts in a simplified form that is further described below in the Detailed Description. This Summary is not intended to identify key aspects or essential aspects of the claimed subject matter. Moreover, this Summary is not intended for use as an aid in determining the scope of the claimed subject matter.

Provided in an embodiment, the apparatus is a dual robotic sorter for use in identifying defective and/or damaged product from a conveyor comprising a central processing unit, an imaging device in operable communication with the central processing unit, a robotic sorting device comprising two means for sorting a product wherein the robotic sorting device and two means for sorting product are in operable communication with the central processing unit. Furthermore, the robotic sorting device is connected to a frame. The first sorting means comprises a vacuum suction based transport tool that further comprises a compressed air source connected to a suction tube with at least two, disparate ends and a movable gate positioned at an opening at an end of the suction tube. The second sorting means comprises a vacuum pick-and-place tool comprising a vacuum source, which may be the compressed air source of the first sorting means, connected to a cup or nozzle with sufficient suction to hold a product without damaging it for pick-up and placement in a new location.

The dual robotic sorting apparatus further comprises a linear actuator on at least one of the sorting means that extends the connected sorting means below the horizontal plane of the other sorting means when activated. The linear actuator is also in operable communication with the central processing unit. A light source may be used in conjunction with the imaging device to illuminate the product to be imaged. It is contemplated the light source is a light-emitting diode ("LED") and emits light that is visible and/or invisible to the human eye. The dual robotic sorter of the preferred embodiment also includes an ejector mechanism connected to the vacuum pick-and-place tool. The ejector mechanism comprises an air source, separate from the compressed air source, connected via an air tube to the pick-and-place tool. The ejector mechanism is in operable communication with the central processing unit and, when activated, creates a positive pressure air stream to counteract the vacuum suction of the pick-and-place tool to release the picked-up product without requiring the compressed air source to be turned off. Alternatively, the vacuum pick-and-place tool may not include an ejector mechanism and may instead rely on a vacuum source separate from the compressed air source of the vacuum suction tube transport tool.

In an alternative embodiment, multiple dual robotic sorting apparatuses are setup to communicate with one another or share a single central processing unit to coordinate controls across multiple apparatuses. In this embodiment a first sorting apparatus with a first conveyor transports products, a second sorting apparatus with a second conveyor also transports products and a third sorting apparatus receives products from the first and/or second sorting apparatuses. Each sorting apparatus contains all of the above-described features, specifically, an imaging device, an optional illumination source, a robotic arm with at least two sorting means, one of which utilizes a linear actuator, wherein the sorting means are a vacuum pick-and-place tool and a vacuum suction tube transport tool. Each conveyor of each apparatus may also be connected to an encoder that is in operable communication with the central processing unit of each, respective sorting apparatus or with the shared central processing unit between all the sorting apparatuses. The second conveyor of the second sorting apparatus is contemplated as being positioned downstream from the first conveyor and the second conveyor is also positioned on a horizontal plane below the first conveyor so that products from the first conveyor are flipped to a second side when sorted onto the second conveyor. The third conveyor of the third apparatus receives products from at least one of the first and second sorting apparatuses that are identified as defective and/or damaged. The third sorting apparatus again images and analyzes the products identified as defective/damaged and transports misidentified damaged products that are actually non-damaged products back to at least one of the first or second sorting apparatuses.

Also provided is a method of identifying and sorting a product on a conveyor comprising the steps of illuminating the product with a light source, imaging the product using at least one imaging device, analyzing the image, a robotic arm with a sorting means, and activating one of at least two available sorting means for sorting the product. The first sorting means comprises a vacuum suction tube transport tool and the second sorting means comprises a vacuum pick-and-place tool to pick up identified products and move them to another location using the robotic arm. The preferred embodiment of the method utilizes a light-emitting diode as a light source to perpenate products as they pass by the imaging device. The light-emitting diodes may emit visible or invisible light to the human eye.

The above-mentioned method and apparatuses solve the problems disclosed in the Background and have numerous advantages over the traditional means of sorting product on a conveyor. Additionally, other features and advantages of the method and apparatus will become more fully apparent and understood with reference to the following Detailed Description, Drawings, and Claims.

DETAILED DESCRIPTION

The following provides one or more examples of embodiments of a robotic sorting method and apparatus. For ease of discussion and understanding, the robotic sorter 100 is illustrated in association with corn or other agricultural products and utilizes conveyors 120, 122, 124, 126, and 128 to transport agricultural products to be sorted to the robotic sorting mechanisms. It should be appreciated that conveyors 120, 122, 124, 126, and 128 may be any type, style, or arrangement of conveyors. Furthermore, the conveyors 120, 122, 124, 126, 128 may be any currently known or a future developed conveyor for which it would be advantageous to use with one or more examples or embodiments of the robotic sorting apparatus of the present invention. It should also be appreciated that products of any type, style, shape, or arrangement may be utilized with the system of the present invention. Furthermore, products to be sorted may be any currently known or future developed products for which it would be advantageous to use with one or more examples or embodiments of the robotic sorting apparatus of the present invention.

Figure 1:
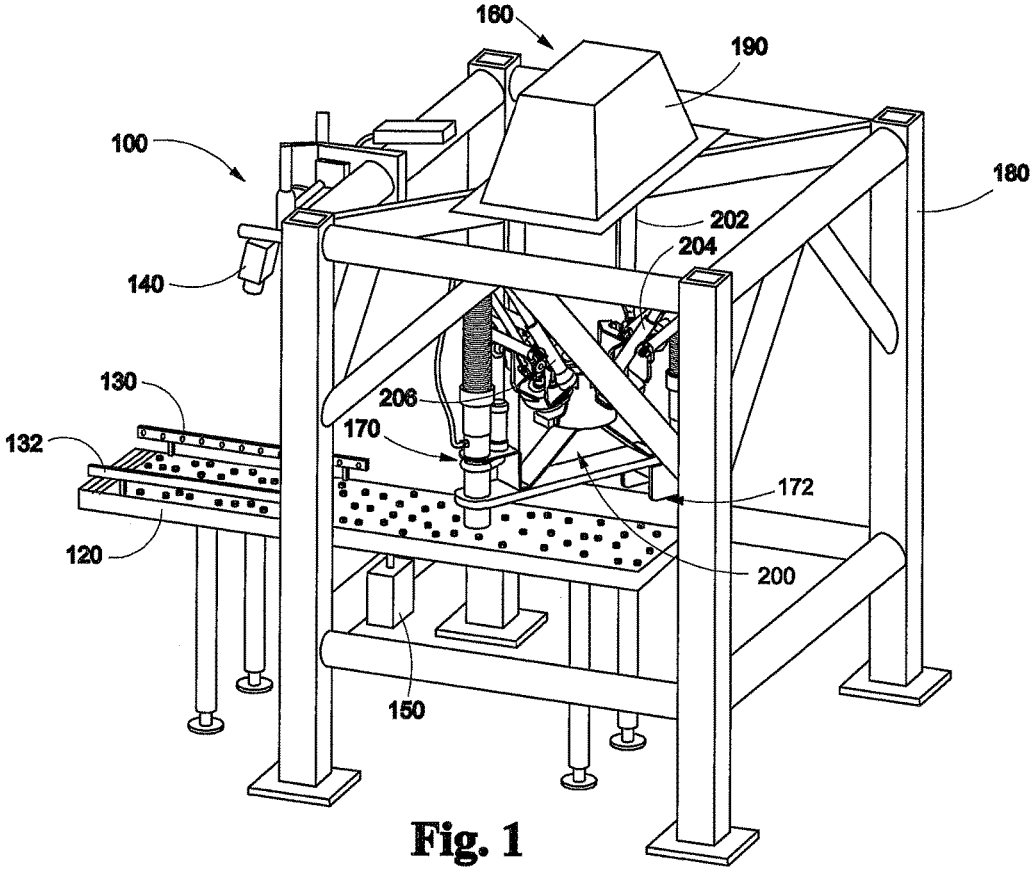
FIG. 1 is a perspective view of the dual robotic sorter of the preferred embodiment of the present invention.

FIG. 1 illustrates the process of sorting product, such as corn, from a conveyor 120 using a robotic sorter 100. As the product travels along the conveyor 120 a light source illuminates the product. The light source in the preferred embodiment is at least one Light Emitting Diode ("LED"), although two LEDs 130, 132 are shown in the drawings, which may emit specific colors of light that better illuminate the product on the conveyor 120. It is anticipated that any light source may work, including ambient light, depending on the quality of the imaging device and the product that is illuminated. Additionally, it is anticipated that more than one light source may be used to illuminate the product. Furthermore, it is anticipated that the light may be of any frequency including, but not limited to, infrared, visible, and ultraviolet.

After the product has been illuminated, an imaging device 140 captures an image of the product and communicates that image to the Controller/Central Processing Unit (hereinafter "CPU") 150 (shown in FIG. 2). The imaging device 140 in the preferred embodiment may be any available device suitable for capturing the image of the product. Currently, some specific cameras that accomplish acceptable imaging include, but are not limited to, Cognex and Sony XC-56 Progressive Scan Camera with lens filter and camera enclosure to improve application reliability. The image captured may be a color image or any type of image useful in identifying the defective product. It is anticipated that any imaging device 140 suitable for capturing the image of the product may be used. Furthermore, it is anticipated that future developed methods or apparatus may be used to capture the image of the product.

The image of the product is then analyzed by a software program which determines if the product should be removed from the conveyor 120 and sorted. If the program determines that the product should be removed from the conveyor 120 then a signal is sent to the robotic sorter 160 to remove the product from the conveyor 120 and place or transport the product in/to the proper area. The system 100 selects the proper end-of-arm tool 170 and 172, as discussed below, to sort the damage product identified based on the defect classification and/or the height of the product to be sorted detected by the software. The software currently used in the preferred embodiment is R-30iA iRVision. The current software program identifies variations in color, height, geometry, and texture to determine if the product is defective. It is anticipated that changes or updates to the software may be made and that the software may be used to analyze different aspects of different product in different ways. Furthermore, it is anticipated that any software currently known or developed in the future that is capable of analyzing the images and/or operating the optical robotic sorter 100 may be used.

The robotic sorter 160, of the robotic sorter system 100, is an automated means of sorting the product from the conveyor. In the preferred embodiment, the robotic sorter 160 is a Fanuc M-3iA 4 Axis Food Grade Robot which has two added end-of-arm tools 170 and 172, which will be referred to as the vacuum pick-and-place tool 170 and the vacuum transport tool 172. The robotic sorter 160 is inverted and attached to a structural frame 180 for support and protection. The robotic sorter 160 may be attached to the structural frame 180 by any suitable means and in any configuration capable of properly supporting the robotic sorter 160. In the preferred embodiment, the primary servo housing 190 of the robotic sorter 160 is attached to the structural frame 180. Additionally, the servo housing 190 has three arm members 202, 204 and 206 attached thereto which make up the robotic arm 200. The three arm members 202, 204 and 206 connect to a tool assembly 192 which, in turn, holds the vacuum pick-and-place tool 170 and the vacuum transport tool 172, arranged substantially parallel to one another, on either side of the tool assembly 192 (also shown in FIG. 3). It should be appreciated that any advantageous arrangement of the vacuum pick-and-place tool 170 and the vacuum transport tool 172 including multiple tools of one or both types may be utilized without departing from the scope of the present invention.

The servo housing 190 contains motors and other mechanisms necessary to operate the robotic arm 200. The arm members 202, 204, 206 allow the robotic arm 200 to position the end-of-arm tools 170 and 172 near product traveling along the conveyor 120 (shown in FIGS. 1-2). In the preferred embodiment, the vacuum pick-and-place tool 170 is telescopic. This allows the pick-and-place tool 170 to position the nozzle or cup 218 against product, such as corn, and ultimately remove the product from the conveyor 120 (shown in FIGS. 1-2). The suction from the vacuum source 210 allows the pick-and-place tool 172 of the robotic sorter 160 to pick up the product, remove the product from its location, and sort the product. In the preferred embodiment, the vacuum cup 218 of the pick-and-place tool 170 is made of silicon and is flexible enough to allow the robotic sorter 160 to pick up product even when the vacuum cup 218 is not directly centered against the product. Additionally, the flexibility of the vacuum cup 218 helps to prevent faults from occurring. It is anticipated that the vacuum pick-and-place tool 170 or the vacuum cup 218 may have different configurations or may be made out of any material capable of accomplishing their purpose.

Figure 2:
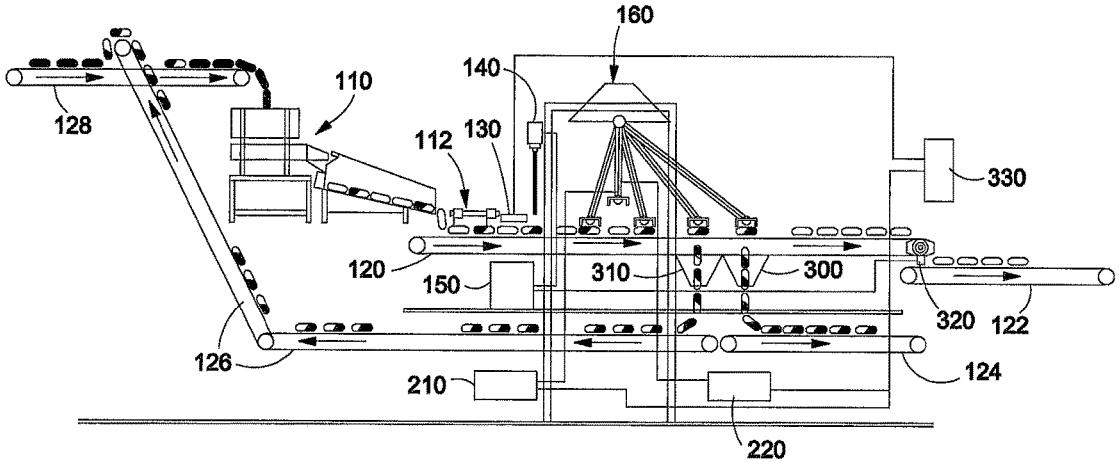
FIG. 2 is a flow diagram illustrating the process of sorting a product on a conveyor of the dual robotic sorter of the preferred embodiment of the present invention.

The vacuum pick-and-place tool 170 is connected to a vacuum source 210 (shown in FIG. 2). In the preferred embodiment, the vacuum transport tool 172 is connected to the same vacuum source 210. In the preferred embodiment, the vacuum source 210 is an air compressor and uses compressed air to create a vacuum, using the venturi effect, for each end-of-arm tool type. However, it should be appreciated that any type of source to create a vacuum within each end-of-arm tool may be utilized without departing from the scope of the present invention. Additionally, the vacuum source 210 may be connected to the end-of-arm tools 170 and 172 by any means and may be located in any location where the vacuum source 210 would be operable. The vacuum from the vacuum source 210 is run to a nozzle or cup 218 at the end of the vacuum pick-and-place tool 170. The vacuum pick-and-place tool 170 of the preferred embodiment utilizes an air source that is connected to the ejector mechanism 214 of the vacuum pick-and-place tool 170. The ejector mechanism 214, when activated by the CPU 150, activates the air source to produce a stream of air creating a positive air pressure stream which ejects or releases the item picked up by the vacuum of the pick-and-place tool 170. It should be appreciated that any amount of ejection pressure may be utilized to achieve the desired result of ejecting the product, while not damaging the product. The vacuum from the vacuum source 210 is run to a transport tube 222 of the vacuum transport tool 172 of sufficient diameter to envelope and transport damaged products off the conveyor 120. Alternatively, the vacuum source 210 may be a vacuum pump or any other means of creating the necessary vacuum in the vacuum pick-and-place tool 170 and vacuum transport tool 172.

When the robotic sorter 160 receives a signal to remove the product from the conveyor 120, the signal of the preferred embodiment includes a designation for which vacuum tool 170 or 172 to utilize, and the robotic arm 200 positions the tool 170 or 172 next to the product. In the preferred embodiment, the tools 170 and 172 are brought into proper orientation using one or more linear actuators 216 (shown in FIGS. 3, 4, 5, and 6). If the vacuum pick-and-place tool 170 is utilized, the nozzle or cup 218 wraps around the product creating a seal. The robotic arm 200 is then able to pick up the product and position the product away from the conveyor 120. As previously described, the pick-and-place ejector mechanism 214 creates a stream of positive air pressure to eject or release the product to its new location. This allows products picked up by the pick-and-place tool 170 to be released without requiring the entire vacuum be turned off which would potentially detrimentally affect products being carried by the vacuum transport tool 172 if the two tools are sharing a vacuum source. In an alternate embodiment, the vacuum source 210 may be utilized by only the pick-and-place tool 170 and a second vacuum source 220 is used in conjunction with the vacuum transport tool 172. Thereby allowing the vacuum source 210 of the pick-and place tool 170 to be turned off to release a product to a new location without affecting the second vacuum source 122 and the vacuum transport tool 172 connected to it.

Alternatively, if the vacuum transport tool 172 is selected, the robotic arm moves the pickup tube 222 over and down to the product to be transported so that the product is held against the opening in the moveable gate 224. The CPU 150 then signals to open the movable gate 224 and the product is transported through the tube 222 to another location. Utilizing the moveable gate 224 to pick the product to be sorted off the bed of the conveyor 120 minimizes collateral picks and causes no, or minimal, disturbance to the products on the conveyor bed, allowing for other defects to be efficiently removed. Each end-of-arm tool has its own advantages. Specifically, the vacuum transport tool 172 is faster in comparison to the vacuum pick-and-place tool 170 since there is less movement of the robotic arm 200 required. Specifically, the transport tube 222 transports the defective/damaged product to another location once the product is picked up whereas the vacuum pick-and-place tool 170 requires the robotic arm 200 to move the product to another location. However, for products that are not conducive to transport via vacuum tube, i.e. products that leave behind residues that build up in the transport tubes 222 of the vacuum transport tool 172, the vacuum pick-and-place tool 170 is better suited to pick up and place these types of products in a new location. Additionally, the vacuum pick-and-place tool 170 allows for the robotic sorter 160 to transport products, for example based on the type or level of the defect/damage, to multiple end locations utilizing a single tool head.

FIG. 2 is a flow diagram illustrating the process of sorting a product on a conveyor 120. Initially, the product is delivered to a hopper unit 110 to spread the product across the conveyor 120. Once the products are spread on the width of the conveyor 120, the products are transported to a depiler 112. The depiler 112 ensures that the products are not stacked on top of each other. In the preferred embodiment, the depiler 112 comprises two metal bars with connected strips of material hanging down towards the conveyor 120. The two metal bars are connected by at least one metal pole. FIG. 2 only show a side view of the metal bars and the metal pole connecting the metal bars. Additionally, only one strip of material may be seen in FIG. 2 connected to each metal bar, however, any number of strips of material may be connected to the metal bars. In the preferred embodiment, the strips of material stop approximately two inches above the conveyor 120 to prevent stacked products from continuing along the conveyor 120. However, it should be appreciated that the depiler 112 may be made of any material and may be positioned in any configuration that prevents stacked or piled products from traveling along the conveyor 120 to the imaging device 140. It is anticipated that other means of depiling products may be employed or that other embodiments may not need to depile the products.

After the products have been depiled, they continue to travel along the conveyor 120 and are then illuminated by at least one light source. The light sources illustrated in the figures and used in the preferred embodiment are LEDs 130, 132. In the preferred embodiment, the LEDs 130 and 132 are placed next to and on each side of the conveyor 120. The illuminated products are then imaged by an imaging device 140. In the preferred embodiment, the images are sent to the CPU 150 and analyzed by a software program to identify defective or damaged products from acceptable products. The system is also capable of identifying various levels of defects/damage in the products to allow a user to separate slightly defective/damaged products from extremely defective or damaged products. The CPU 150 may be any currently known or future developed central processing unit capable of processing the necessary functions associated with this method and apparatus. Additionally, it is anticipated that the CPU 150 may be incorporated into the disclosed equipment or any other equipment. Also, the CPU 150 could be connected through alternate means, such as wirelessly connected. Furthermore, the CPU 150 could be located anywhere as long as it is still able to make the necessary connections and is operable. The CPU 150 is also connected to the control panel 330, the encoder 320, the vacuum source 210, and the robotic sorter 160

After the images of the products are analyzed, a signal is sent to at least one robotic sorter 160 to pick or transport the damaged and/or defective products from the conveyor 120 into at least one area for receiving defective products. In the preferred embodiment, the robotic sorter 160 is sorting at a rate of approximately ninety (90) picks per minute. The robotic sorter 160 is capable of sorting faster and should be able to sort at a minimum rate of at least forty five (45) picks per minute. It is anticipated that the robotic sorter may be of any configuration that would be able to properly remove and sort the product from the conveyor 120. Additionally, in the preferred embodiment, the conveyor 120, LEDs 130, 132, imaging device 140, encoder 320, control panel 330, and robotic sorter 160 are also located on the main floor of the building. In the preferred embodiment, the acceptable products continue along the conveyor 120 to a second conveyor 122 or a chute leading to a second conveyor 122 for further processing. The damaged/defective products are dropped into or transported to a first or discharge chute 300 and onto a third, or discharge, conveyor 124. The damaged/defective products are then removed from the process. Unanalyzed or questionable products are dropped into a second, or return, chute 310 and returned to the hopper unit 110 by the fourth, or return, conveyor 126. The return conveyor 126 may unload the products onto a fifth, or delivery, conveyor 128. The delivery conveyor 128 may be initially used to transport the products from initial delivery to the hopper unit 110. Ultimately, the returned product begins the process again. FIG. 2 also illustrates some of the connections between the hardware used in the process, such as the encoder 320 and the control panel 330. The encoder 320 measures the speed of the conveyor 120 and communicates with the CPU 150. In the preferred embodiment, the conveyor 120 moves at an approximate speed of one hundred and twenty (120) feet per minute. The conveyor 120 is capable of moving faster and should be able to move at least fifty (50) feet per minute to process the product on the conveyor 120. Additionally, the conveyor 120 may have a variable speed drive (not shown) and the encoder 320 may be used to slow down or speed up the conveyor 120 to assist in the processing and sorting of the product. It is also anticipated that the speed of the conveyor 120 may also be controlled from the control panel 330. In the preferred embodiment, the control panel 330 operator is able to initiate the process, stop the process, reset the process, turn off and on the LEDs 130, 132, and generally control all of the equipment associated with the process. Additionally, the process will automatically stop if a fault is triggered. A fault may be caused by a malfunction in the equipment, damaged equipment, the product or equipment getting jammed or other errors in the processing. When a fault has been triggered the conveyors automatically stop transporting the product and the robotic sorter 160 automatically stops sorting the product. This allows the fault to be identified and fixed. After the fault has been addressed, the process is reset and the transferring and sorting of the product continues.

Figure 3:
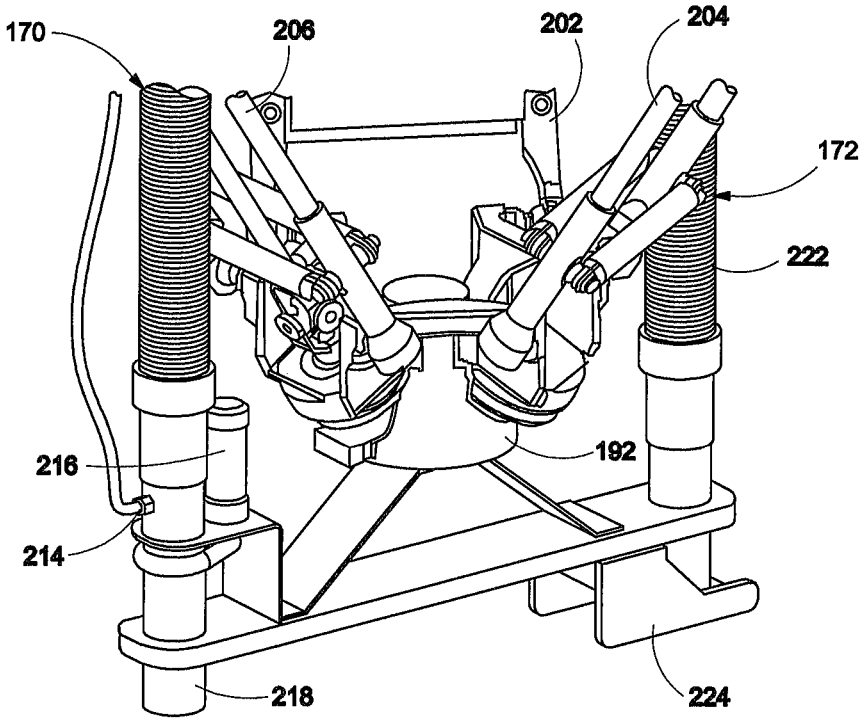
FIG. 3 is a perspective view of the linear dual sorting means of the dual robotic sorter of the preferred embodiment of the present invention with the vacuum suction tube transport tool in the lowered, pick-up position.
Figure 4:
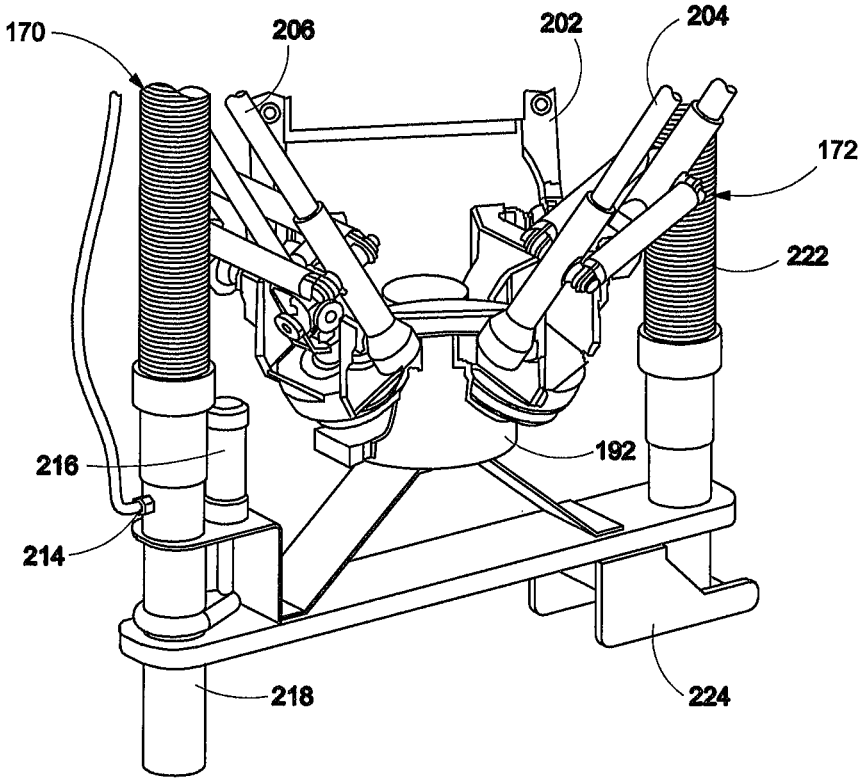
FIG. 4 is a perspective view of the linear dual sorting means of the dual robotic sorter of the preferred embodiment of the present invention with the vacuum pick-and-place tool in the extended, pick-up position.

FIGS. 3 and 4 are perspective views of the linear dual vacuum sorting tools 170 and 172 of the present invention. As illustrated in FIGS. 3 and 4, the robotic arm members 202, 204, and 206 are connected to the tool assembly 192. The tool assembly 192 is, in turn, connected to the linear tool assembly holding the vacuum pick-and-place tool 170 and the vacuum transport tool 172 substantially parallel to one another on either side of the tool assembly 192. It should be appreciated that any arrangement of the vacuum tools 170 and 172 may be utilized without departing form the scope of the present invention. Furthermore, it is contemplated that additional vacuum pick-and-place tools, vacuum transport tools, or other sorting mechanisms are also attached to the tool assembly 192 and utilized by the system 100. The first end-of-arm tool 170 or 172 is placed slightly below, along the vertical axis, the other tool(s) attached to the tool assembly 192. This slightly lower tool is the default end-of-arm tool of the robotic sorter 160 and can be either the vacuum pick-and-place tool 170 or the vacuum transport tool 172. The other tool utilizes a linear actuator with enough vertical travel to allow the pickup end of this tool to extend below the plane of the first tool. As depicted in FIG. 3, the vacuum pick-and-place tool 170 is associated with the linear actuator making the vacuum transport tool 172 the default sorting mechanism in the preferred embodiment. Accordingly, the transport tube 222 and movable gate 224 of the vacuum transport tool 172 is slightly below the end of the nozzle or cup 218 of the vacuum pick-and-place tool 170. As described above, in this orientation, once a corresponding signal is received from the CPU 150, the robotic arm moves the pickup tube 222 over and down to the product on the conveyor 120 to be transported so that the product is held against the opening in the moveable gate 224. The CPU 150 then signals to open the movable gate 224 and the product is transported through the tube 222 to another location.

As shown in FIG. 4, when the linear actuator 216 is activated, the second end-of-arm tool is moved to a vertical position below the first end-of-arm tool. In the preferred embodiment, the linear actuator 216 is associated with the vacuum pick-and-place tool 170. Accordingly, once the robotic arm 200 is properly positioned above the product to be sorted, the linear actuator 216 is activated, based on an appropriate signal from the CPU 150, which causes the nozzle or cup 218 of the vacuum pick-and-place tool 170 to move below the vertically, lower-most position of the vacuum transport tool 172. The nozzle or cup 218 wraps around the product creating a seal. The robotic arm 200 is then able to pick up the product and position the product away from the conveyor 120. As previously described, the pick-and-place ejector mechanism 214 creates a stream of positive air pressure to eject or release the product once it is moved to its new location. It should be appreciated that any number of additional pickup/transport tools may be utilized with the tool assembly 192 by adding additional tools with linear actuators for each tool. Thereafter, the appropriate tool, other than the default tool, is selected by activating the linear actuator associated with that particular tool.

Figure 5:
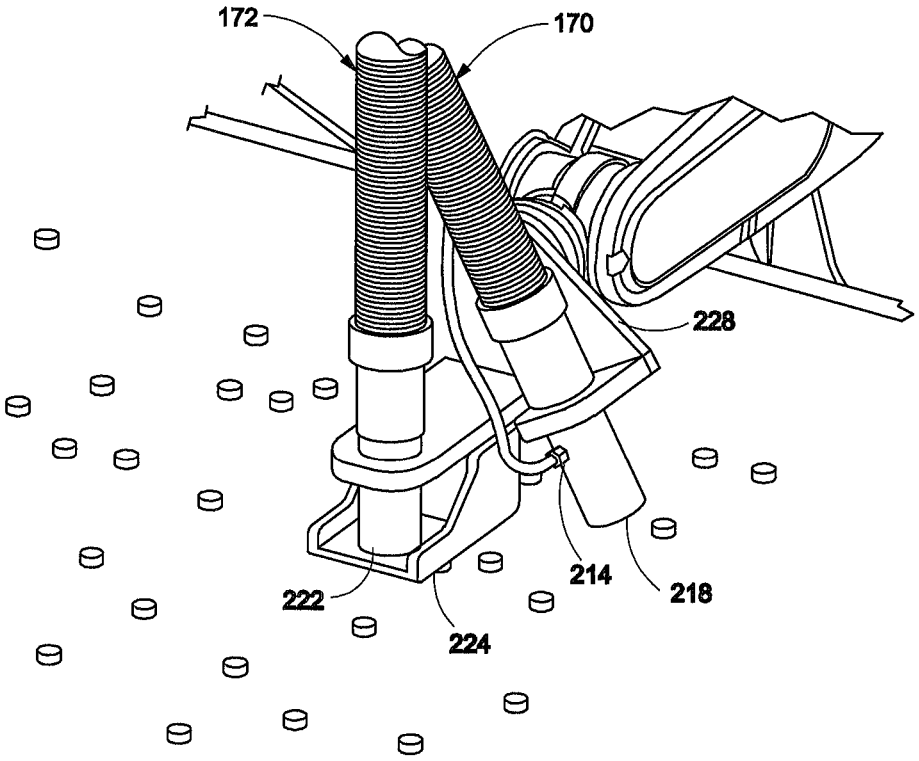
FIG. 5 is a perspective view of a first alternative embodiment with a rotatable dual sorting means of the dual robotic sorter of the present invention with the vacuum suction tube transport tool in the perpendicular pick-up position.
Figure 6:
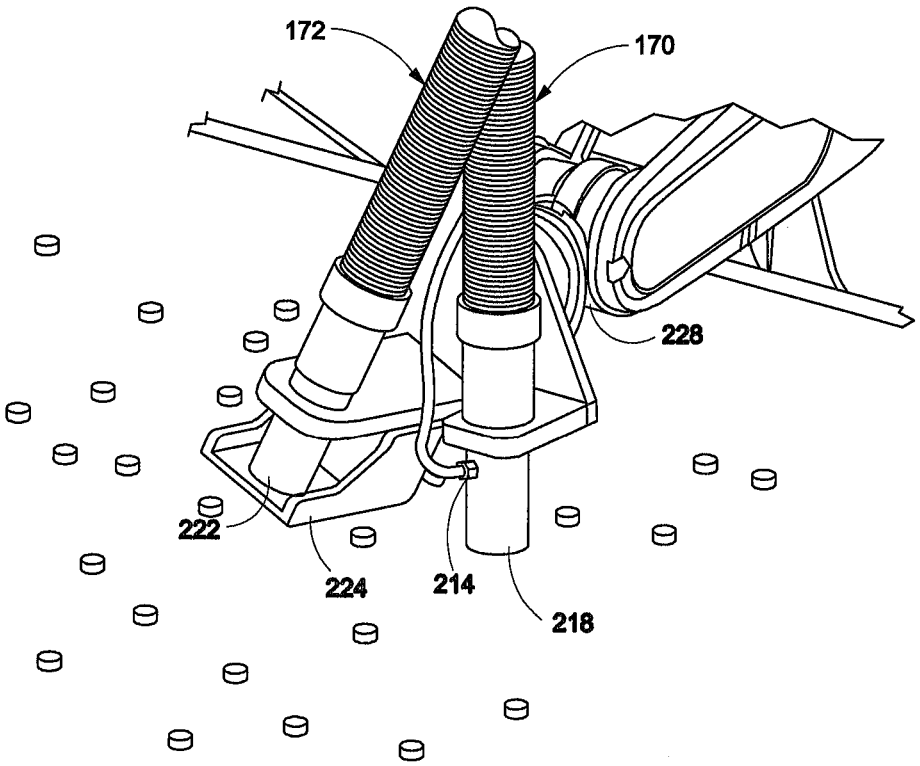
FIG. 6 is a perspective view of the first alternative embodiment with a rotatable dual sorting means of the dual robotic sorter of the present invention with the vacuum pick-and-place tool in the perpendicular pick-up position.

Turning to FIGS. 5 and 6, provided is an alternative embodiment of the present invention, utilizing a rotatable assembly 228 to allow the system 100 to select the vacuum pick-and-place tool 170 and the vacuum transport tool 172. In this embodiment, the rotatable assembly 228 is connected to an "arm" style robot's "wrist" articulation point. The robotic arm may be of any style currently known or developed in the future including, but not limited to, floor standing or wall mounted robotic arms 200. As shown in FIG. 5, the vacuum transport tool 172 is rotated into a position substantially perpendicular to the conveyor 120 below. In this orientation, the fixed rotatable assembly 228 causes the second tool, the vacuum pick-and-place tool 170, to be rotated above the lowest point of the first tool. This keeps the second tool from picking up products while the first tool is in use.

FIG. 6 provides the alternative orientation, where the robotic arm 200 rotates along it's wrist articulation point to rotate the rotatable assembly 228 so that the vacuum pick-and place tool 170 is substantially perpendicular to the conveyor 120 below. As expected, the rotation of the rotation assembly and connected end-of-arm tools 170 and 172 causes the vacuum transport tool 172 to be rotated above the lowest point of the pick-and-place tool 170 thereby avoiding accidental transport of products from the conveyor 120. It is anticipated additional tools may be placed on the rotatable assembly 228 as long as the "wrist" of the robotic arm 200 is able to rotate each tool into a substantially perpendicular position with the conveyor 120 below. It is contemplated that a 360 degree rotatable "wrist" may be utilized to maximize the number of tools utilized with a single robotic arm 200 in this alternative embodiment.

Figure 7:
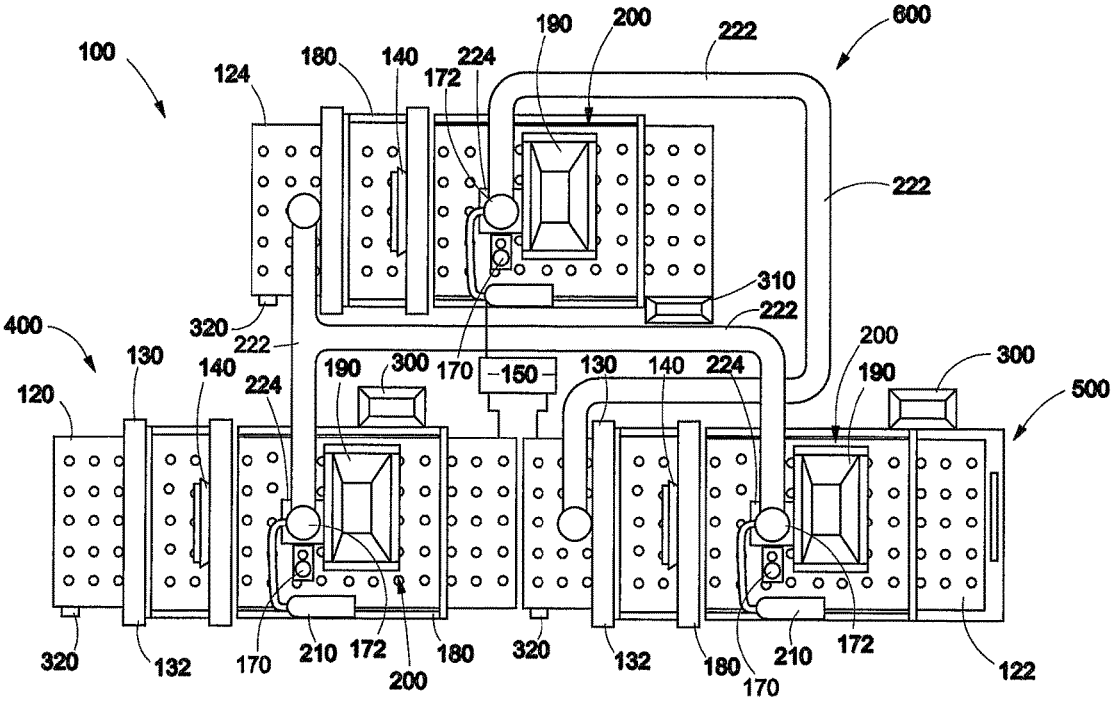
FIG. 7 is a top plan view of a second alternative embodiment with multiple dual robotic sorters of the present invention interconnected.

FIG. 7 depicts yet another alternative embodiment of the system of the present invention. In this alternative embodiment, it is contemplated that the first, second, and third conveyors 120, 122, and 124 each house a frame 180, servo housing 190, robotic arm 200, light source, imaging device 140, tool assembly 192 or 228, vacuum source 210, and vacuum pick-and-place tool 170 and vacuum transport tool 172. For ease of discussion each above identified combination will be referred to as a first sorting assembly 400, a second sorting assembly 500, and a third sorting assembly 600. It should be appreciated that additional sorting assemblies may be utilized without departing from the scope of the present invention. The dual vacuum pickup/transport tools at the end of each robotic arm 200 of each assembly 400, 500, and 600 is contemplated in either the linear assembly of the preferred embodiment or the rotatable assembly of the alternative embodiment as discussed above. In this embodiment the conveyor 120 of the first assembly 400 is positioned above and immediately adjacent to the second assembly 500 such that product moving off the conveyor 120 of the first assembly 400 falls on the conveyor 122 of the second assembly 500. Additionally, if the conveyor 122 of the second assembly 500 is positioned below the horizontal plane of the first conveyor 120 of the first assembly 400, the products should naturally flip to the opposite side they were lying on the first conveyor 120. Accordingly, the first assembly 400 will analyze and sort products based on images of one side of the product and the second assembly 500 will analyze and sort products based on images of the opposite side imaged on the first assembly 400. In this embodiment, the third conveyor 124 and assembly 600 is placed out of line and spaced apart from the first and second assemblies 400 and 500. However, it should be appreciated that the assemblies may be spaced in any arrangement preferred and additional assemblies may be added if desired without departing from the scope of the present invention. Each conveyor 120, 122, and 124 includes an encoder 320 that sends information to the CPU 150. A single CPU 150 may be utilized among all the assemblies 400, 500, and 600 or separate CPUs 150 that communicate with one another may be utilized.

The assemblies 400, 500 and 600 are interconnected via one or more transport tubes 222 and/or chutes 300 and 310. In operation, product is loaded on one end of the conveyor 120 of the first assembly 400, the product is illuminated, and imaged by the LEDs 130 and 132 and imaging device 140, respectively. The CPU 150 analyzes the images and direct the robotic sorter 160 to utilize the vacuum transport tool 172 or vacuum pick-and-place tool 170 on each identified damaged or defective product. Product to be sorted by the pick-and-place tool 170 of the first assembly 400 is moved to a discharge chute 300 on the first assembly 400 that transports the products to the third assembly 600. Product to be sorted by the vacuum transport tool 172 of the first assembly 400 is transported via the transport tube 222 to the third assembly 600. As the damaged products approach the sorting device, the CPU 150 determines the most efficient tool and order to pick up each damaged or defective product. The CPU 150 analyzes the information provided by the encoder 320 to calculate the sorting order for the highest efficiency and to transmit the required locational information to the robotic sorter 160. Acceptable products are carried to the end of the first conveyor 120 until they fall off the end of the first conveyor 120 onto the conveyor 122 of the second assembly 500. Again, the second conveyor is placed slightly below the horizontal plane of the first conveyor, causing products that fall off the first conveyor to flip as they fall.

Once the acceptable products from the first assembly 400 land on the conveyor 122 of the second assembly 500 the process repeats itself with the imaging device (capturing images of the opposite side imaged on the first assembly 400) and robotic sorter of the second assembly 500. Products deemed acceptable at the end of the second assembly 500 may be imaged again by another imaging device 140 or may be allowed to fall off the second assembly conveyor 122 to a packaging area. Products transported to the conveyor 124 of the third assembly 600 are once again illuminated, imaged, and analyzed for previously misidentified defects/damage. If a product was misidentified as damaged, the robotic sorter 160 of the third assembly 600 is instructed by the CPU 150 to transport the misidentified product to the first or second assembly 400 or 500.

The foregoing embodiments provide advantages over currently available processes and devices. In particular the dual robotic sorter 100, the process of sorting product, and the associated features described herein reduce the dependence on human labor and the problems associated with human labor. Additionally, this process and apparatus increases sorting efficiency and accuracy while ultimately reducing the associated costs. The process and apparatus disclosed are able to identify defective and/or damaged product and sort or directly transport the defective/damaged product into one or more sorting areas. Furthermore, defective/damaged product may be returned to the beginning of the process or removed from the process.

Although various representative embodiments of this invention have been described above with a certain degree of particularity, those skilled in the art could make numerous alterations to the disclosed embodiments without departing from the spirit or scope of the inventive subject matter set forth in the specification and claims. All directional references, including but not limited to, upper, lower, upward, downward, left, right, top, bottom, above, and below are only used for identification purposes to aid the reader's understanding of the embodiments of the present invention, and do not create limitations, particularly as to the position, orientation, or use of the invention unless specifically set forth in the claims. Joinder references (e.g., attached, coupled, connected) are to be construed broadly and may include intermediate members between a connection of elements and relative movement between elements. As such, joinder references do not necessarily infer that two elements are directly connected and in fixed relation to each other. Additionally, those skilled in the art will recognize that the present invention is not limited to components which terminate immediately beyond their points of connection with other parts. Thus, the term "end" should be interpreted broadly, in a manner that includes areas adjacent, rearward, forward of, or otherwise near the terminus of a particular element, link, component, part, and member. In methodologies directly or indirectly set forth herein, various steps and operations are described in one possible order of operation, but those skilled in the art will recognize that steps and operations may be rearranged, replaced, or eliminated without necessarily departing from the spirit and scope of the present invention. It is intended that all matter contained in the above description or shown in the accompanying drawings shall be interpreted as illustrative only and not limiting. Although the present invention has been described with reference to certain embodiments, persons ordinarily skilled in the art will recognize that changes in detail, form, or structure may be made without departing from the spirit of the invention as defined in the appended claims.

Although the present invention has been described with reference to the embodiments outlined above, various alternatives, modifications, variations, improvements and/or substantial equivalents, whether known or that are or may be presently foreseen, may become apparent to those having at least ordinary skill in the art. Listing the steps of a method in a certain order does not constitute any limitation on the order of the steps of the method. Accordingly, the embodiments of the invention set forth above are intended to be illustrative, not limiting. Persons skilled in the art will recognize that changes may be made in form and detail without departing from the spirit and scope of the invention. Therefore, the invention is intended to embrace all known or earlier developed alternatives, modifications, variations, improvements, and/or substantial equivalents. The invention should therefore not be limited by the above described embodiment, method, and examples, but by all embodiments and methods within the scope and spirit of the invention.

What is claimed is:

1. A sorting apparatus for identifying and sorting product on a conveyor comprising:

a. an imaging device for identifying products;

b. a central processing unit in communication with and controlling said imaging device c. said central processing unit in communication with and control of said apparatus and said conveyor;

d. a robotic sorting device comprising a first means and a second means for sorting said product in communication with and controlled by said central processing unit;

e. wherein said first means for sorting said product comprises a movable vacuum suction tube based transport tool comprising a compressed air source connected to a suction tube with at least two disparate ends and a moveable gate positioned at an opening at an end of said suction tube;

f. said second means for sorting said product comprises a vacuum pick-and-place tool; and g. said central processing unit determines which said sorting means to utilize and an order of movement of said robotic sorting device to pickup said product identified.

2. The apparatus of claim 1 wherein at least one of said first and second sorting means further comprises a linear actuator.

3. The apparatus of claim 1 further comprising a light source in communication with and controlled by said central processing unit.

4. The apparatus of claim 1 wherein said compressed air source of said vacuum suction tube transport tool creates a vacuum within said suction tube when compressed air is released form said compressed air source.

5. The apparatus of claim 1 wherein said compressed air source is simultaneously connected to said second sorting means to produce said vacuum of said second sorting means.

6. The apparatus of claim 5 wherein said vacuum pick-and-place tool further comprises an ejector mechanism in communication with and controlled by said central processing unit.

7. The apparatus of claim 6 wherein said ejector mechanism comprises an air tube connected to a second air source on one end and said pick-and-place tool on an opposite end.

8. The apparatus of claim 7 wherein said ejector mechanism, when activated by said central processing unit, creates a positive pressure air stream to counteract said vacuum without turning off said compressed air source.

9. The apparatus of claim 1 further comprising a second compressed air source connected to said vacuum pick-and-place tool wherein said second compressed air source creates a vacuum within said vacuum pick-and-place tool when compressed air is released from said second compressed air source.

10. The apparatus of claim 1 wherein said central processing unit selects said sorting means and most efficient order of removing product based upon information received and a position of said product.

11. The apparatus of claim 1 wherein multiple sorting apparatuses are in communication with each apparatus' central processing unit or multiple apparatuses share a single central processing unit.

12. The apparatus system of claim 11 wherein a first sorting apparatus further comprises a chute that transports products to a receiving end of a third sorting apparatus and wherein said suction tube has an end opposite said moveable gate with an opening above said receiving end of said third sorting apparatus.

13. The apparatus system of claim 12 wherein product picked up by said vacuum suction tube based transport tool is transported by said suction tube to said receiving end of said third sorting apparatus and product picked up by said vacuum pick-and-place tool is released into said chute.

14. The apparatus system of claim 11 wherein a second sorting apparatus is positioned downstream of said first sorting apparatus.

15. The apparatus system of claim 14 wherein a conveyor of said second sorting apparatus is positioned on a horizontal plane below said conveyor of said first sorting apparatus.

16. A method of identifying and sorting a product on a conveyor comprising the steps of:

a. illuminating said product with a light source;

b. imaging said product using at least one imaging device;

c. analyzing said image with a central processing unit in communication with said imaging device, said light source, and a robotic arm comprising, at least two sorting means;

d. activating said robotic arm with said at least two sorting means; and e. activating one of said sorting means, wherein a first sorting means comprises a vacuum suction tube tool to transport product and a second sorting means comprises a vacuum pick-and-place tool to pick up and move said product.

17. The method of claim 16 wherein the light source is a light-emitting diode.

18. The method of claim 16 wherein the light source emits visible light.

19. A robotic sorting apparatus comprising:

a. a central processing unit in communication with and controlling said apparatus;

b. a conveyor connected to an encoder in communication with and controlled by said central processing unit:

c. an imaging device in communication with and controlled by said central processing unit;

d. a robotic arm in operable communication with said central processing unit;

e. wherein said robotic arm is connected to a first means and a second means for sorting said product, wherein said first and second sorting means are in communication with and controlled by said central processing unit;

f. wherein said first means for sorting said product comprises a vacuum suction tube based transport tool comprising a compressed air source connected to a suction tube with at least two disparate ends and a moveable gate positioned at an opening at an end of said suction tube;

g. said second means for sorting said product comprises a vacuum pick-and-place tool comprising a vacuum source connected to a cup with sufficient suction to hold without damaging said product for pick-up and placement in a new location;

h. wherein at least one of said sorting means is operably connected to a linear actuator to cause the connected sorting means to be extendable;

i. wherein said linear actuator is in communication with and controlled by said central processing unit; and j. said central processing unit determines which said sorting means to utilize and an order of movement of said robotic sorting device to pickup said product in the most efficient order of removing product based upon information received and a position of said product.

20. The robotic sorting apparatus of claim 19 further comprising a light source in communication with and controlled by said central processing unit.

21. The robotic sorting apparatus of claim 19 wherein said compressed air source is simultaneously connected to said second sorting means as said vacuum source of said second sorting means.

22. The robotic sorting apparatus of claim 21 wherein said vacuum pick-and-place tool further comprises an ejector mechanism in communication with and controlled by said central processing unit.

23. The robotic sorting apparatus of claim 22 wherein said ejector mechanism comprises an air tube connected to a second air source on one end and said pick-and-place tool on an opposite end.

24. The robotic sorting apparatus of claim 23 wherein said ejector mechanism, when activated by said central processing unit, creates a positive pressure air stream to counteract said vacuum of said pick-and-place tool without turning off said compressed air source.

25. The robotic sorting apparatus of claim 19 further comprising a second compressed air source as said vacuum source of said vacuum pick-and-place tool wherein said second compressed air source creates a vacuum within said vacuum pick-and-place tool when compressed air is released from said second compressed air source.

26. The robotic sorting apparatus of claim 19 wherein multiple sorting apparatuses are in communication with each apparatus' central processing unit or multiple apparatuses share a single central processing unit.

27. The robotic sorting apparatus system of claim 26 further comprising:

a. a first sorting apparatus comprising a first conveyor for transporting said products;

b. a second sorting apparatus comprising a second conveyor for transporting said products;

c. wherein said second sorting apparatus is positioned downstream from said first conveyor;

d. a third sorting apparatus comprising a third conveyor that receives products that have been detected and are determined to be damaged from said at least one of said first and second sorting apparatuses; and e. wherein said third sorting assembly transports non-damaged products on said third conveyor, that were previously determined to be damaged, to at least one of said first and second conveyors of said first and second sorting apparatuses while damaged products are transported separately from said non-damaged products;

f. said third conveyor of said third sorting apparatus, the step of returning said non-damaged products from said third conveyor to at least one of said first and second conveyors occurs after receiving said products on said third conveyor from at least one of said first and second conveyors.

28. The system of claim 27 wherein said second conveyor lies in a horizontal plane below the horizontal plane of said first conveyor such that said products from said first conveyor are flipped to a second side when sorted onto said second conveyor.

* * * * *